US006216396B1

(12) United States Patent
Katz

(10) Patent No.: US 6,216,396 B1
(45) **Date of Patent: *Apr. 17, 2001**

(54) ENTRYWAY PROTECTOR

(75) Inventor: Edward R. Katz, Dunwoody, GA (US)

(73) Assignee: Office Moving Systems, Inc., Cartersville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/580,097

(22) Filed: May 30, 2000

Related U.S. Application Data

(63) Continuation of application No. 09/223,985, filed on Dec. 31, 1998, now Pat. No. 6,128,862.

(51) Int. Cl.[7] ..... E04B 1/344

(52) U.S. Cl. ..... 52/2.11; 52/2.12; 52/2.19; 52/2.25; 52/2.26; 52/211; 52/743.3

(58) Field of Search ..... 52/2.25, 2.11, 52/2.12, 2.19, 2.26, 743.3, 211; 410/119

(56) References Cited

U.S. PATENT DOCUMENTS 3,199,689 * 8/1965 Feldkamp ..... 410/119 X
3,554,135 * 1/1971 Duvall et al. ..... 410/119 X
3,653,710 * 4/1972 Barnard ..... 410/119 X
3,847,091 * 11/1974 Holt ..... 410/119 X
5,813,172 * 9/1998 McNally ..... 52/2.25

* cited by examiner

*Primary Examiner*—Christopher T. Kent
(74) *Attorney, Agent, or Firm*—Harold L. Marquis; Ryan A. Schneider; Troutman Sanders LLP

(57) ABSTRACT

The present invention is an inflatable barrier device for use with elevator door jamb panels and entryway doors and jambs to protect the surfaces of these panels and doors from sustaining damage from collisions with moving equipment, building materials and furniture. The device protects the surfaces from scratches and dents when furniture and construction materials inadvertently bang into these protected surfaces. The entryway protector comprises two sections and securing components. An inflatable main rectangular section is separated by a line of stitching from a minor rectangular section or flap that is filled with padding material. The securing components secure the protector to the surfaces against dislodging by contact with equipment, building materials and furniture.

20 Claims, 5 Drawing Sheets

ENTRYWAY PROTECTOR

This application is a continuation U.S. application Ser. No. 09/223,985, filed Dec. 31, 1998, now U.S. Pat. No. 6,128,862.

BACKGROUND OF THE INVENTION

1. Field of the Invention

The present invention relates to a barrier device for protecting exposed structural surfaces from the inadvertent contact and possible deformation by furniture, equipment, construction materials and the like being moved.

2. Description of Related Art

The relocation industry employs numerous devices and methods in order to provide the quickest, safest and most inexpensive move possible for their clients. Moving companies and related industries constantly develop, test and refine innovative products so that such a move is possible. For example, moving companies often utilize lifting devices that are easily movable through constricted spaces, such as door frames. These lifting devices can safely secure a heavy load and allow just a single man to navigate the load in and out of buildings. These devices also reduce the risk of injury to movers.

A typical office mover employs several individuals, most of whom are loading and unloading furniture on and off of moving equipment or moving the furniture by hand. The moving equipment typically is pushed or pulled through the office, through the office doors, into an elevator, out of the elevator, and through the building's front doors. This procedure is repeated, in reverse, to move the furniture into the new office space. Throughout this moving process, edges and comers of, for example, a hand truck or the furniture can inadvertently come in contact with walls, doors and jambs, not only damaging the moving equipment and furniture, but also the wall, door and jamb surfaces.

Similar to the moving process above, customized construction in an office space can pose a similar risk to both the moving equipment and building materials, and the surfaces of the building's walls, doors and jambs. The expense of repairing damaged walls, doors and door jambs typically falls upon the building owner, the landlord or building management. Thus, movers and contractors rarely bring to the site protective pads to place between the moving loads and the exposed surfaces. Even so, movers and contractors want to minimize such damage to buildings to maintain a quality reputation. Thus, movers and contractors utilize moving equipment designed to avoid this type of damage.

One such product is the Spider Crane® used by Office Moving Systems of Atlanta, Georgia. The Spider Crane® lifts full lateral files with suction high enough to roll a specially designed steel dolly underneath the files. While the cabinet is held safely suspended, a member of the moving crew slides the steel dolly underneath the cabinet which is then gently lowered. This type of device not only reduces injuries, but also enables the client to minimize down time since the Spider Crane® lifts a full file cabinet. Thus, the client need not unload the cabinets and pack the files in boxes. The proper use of this type of device also reduces the expense to the moving company of patching and painting walls damaged by moving the cabinets through the office versus when cabinets are moved in more traditional ways, such as by a two-wheel dolly or hand truck, where there is less control over the cabinets while they are moved in and out of buildings.

Even with the best of care, there is always the risk of damage to property during the moving process. Damage is not confined to the items and products being moved, but can also be sustained by the office or residential structure itself which can be banged, dinged or scratched by the items or the moving equipment such as dollies and hand trucks. The transportation of construction materials through a building passageway also can cause damage, specifically damaging areas of narrowing in the passageway, which are typically at doorways and elevators. An inadvertent scrape can damage the paint, wallpaper and other building surface material.

Barrier-type protection is known for use inside an elevator during a move or construction project. It is common to find hanging mats in the service elevators of many buildings. These hanging mats provide protection to the interior panels of the elevators, which are subjected to the ingress and egress of construction materials and furniture. Not only are the interior panels of a service elevator subjected to scratches and dents, but so are the hallway walls in proximity to the elevator doors, and the entrance doors of the office or residence that typically are propped opened for the movement of such items. Yet these hanging mats are limited for use inside the elevator and are of little use in doorways. Generally, the interior of an elevator is designed with hanging attachments extending from the tops of the interior panels upon which the mats are hung. Such hanging attachments are not incorporated in the construction of, for example, the glass doors of a building's entrance, nor in the design of the jamb panels and hallway walls immediately exterior of the elevator doors. So protecting doors, jamb panels and hallway walls with the hanging mats would require invasive construction of hanging attachments.

There are devices known to provide barrier-type protection between products that have a tendency to jostle together during shipment and transportation. For example, U.S. Pat. No. 5,730,564 to Howlett, Jr. discloses an inflatable air bag to buffer, support, or stabilize cargo loads within transport vehicles. U.S. Pat. No. 5,788,438 to Goshorn et al., discloses an inflatable dunnage bag having an average burst strength of 27 psig. U.S. Pat. No. 5,676,509 to Enzu discloses an absorber inserted into furniture to temporarily secure goods stored in the furniture. when the furniture is transported. The absorber or fastening pad comprises a flat sealed bag having sides of absorbing members.

While it is known to use dunnage bags between items to protect them from the rigors of shipment, none of the art teaches a method of using, or a device incorporating, an equally easy to use and low cost device that can protect building surfaces from damage from furniture or construction materials moved into and out of the building through the building's doors and elevators. Therefore it can be seen that there is a need in the art for a lightweight, easily constructed, inexpensive, noninvasive and portable barrier-type device that can protect such building surfaces.

BRIEF SUMMARY OF THE INVENTION

Briefly described, in its preferred form, the present invention fills a need not presently addressed in the industry by providing an inflatable barrier device for use with elevator door jamb panels and entryway doors and jambs to protect the surfaces of these panels and doors from sustaining damage from collisions with moving equipment, building materials and furniture. The present invention is a protection device placed against the at risk wall or door surface. The device protects the surfaces from scratches and dents when furniture and construction materials inadvertently bang into these protected surfaces.

The present entryway protector is a barrier-type device that a landlord or property manager can quickly and easily install both to protect the elevator jamb panels and the sidewalls of the adjacent elevator hallway, and to protect open doors from scratches and dents. The invention preferably comprises two sections and a securing component. A main rectangular section is separated by a line of stitching from a smaller section, or minor rectangular flap. The main section preferably has an air mattress surrounded by and slipped within a protective sleeve of thick vinyl. The minor flap preferably is a padding-type material fully enclosed by the same vinyl covering.

In applications where the present invention is placed at the entrance of an elevator, the air mattress in the main section is inflated through a stem leading from the air mattress through a hole in the vinyl, until the main section is sufficiently rigid to remain upright when leaned against the surface to be protected. Upon inflation of the main section, the protector is placed so that the minor flap folds along a perpendicular edge of the inflated, main section. The minor flap is placed in contact with, and is hung against, the jamb panel in proximity to the elevator door using the securing component. Preferably, the minor flap is hung on the jamb panel using suction cups. The line of stitching is preferably aligned with the comer edge of the door jamb panel and the hallway wall in which the elevator is set. The main section extends along a portion of the length of the hallway wall from the comer edge, away from the elevator. In this configuration, both the jamb panel of the elevator and a length of the hallway wall are protected from contact with moving equipment, construction materials and furniture.

In another application, the protector can "hug" an open door, so the door can remain open while protected from construction materials or furniture moving in and out of the entrance. In this embodiment, the securing component can comprise loop and hook fasteners combined with straps extending from the main section to secure the protector around the door. In this manner, the door is hugged and secured snug by the protector. The protector is held in place by inserting the straps through the spaces between the hinges of the door, which are then secured to the minor flap.

The main section of the present invention remains upright without any wall attachment because this inflated section has a sufficiently wide bottom edge surface to support it in the upright position, and remains somewhat rigid by inflation. When the minor flap of the present invention is hung against the elevator jamb panel by the securing component, both panels remain upright, and thus stay in place even when contacted by furniture or equipment.

Other features of the present invention include its economical cost, its inflatable activation, and the ease in which the device snugs around a door and is supported near an elevator. Further, unlike furniture pads, the present invention remains in the upright position so the protection device does not crumple to the floor. In order to use furniture pads to protect the hallway walls, hanging attachments must be secured into the wall, which attachments necessarily damage the wall. Conversely, the present invention is noninvasive.

Thus, it is an object of the present invention to provide a lightweight, portable and inexpensive protection device to protect wall and door surfaces from collision with furniture, moving equipment and construction materials.

It is another object of the present invention to provide a protection device that can be easily inflated and placed in position by one individual.

It is a further object of the present invention to provide a protection device comprising an inflatable main section with a padded, minor flap.

These and other objects, features and advantages of the present invention will become more apparent upon reading the following specification in conjunction with the accompanying drawing figures.

DETAILED DESCRIPTION OF A PREFERRED EMBODIMENT

Figure 1:
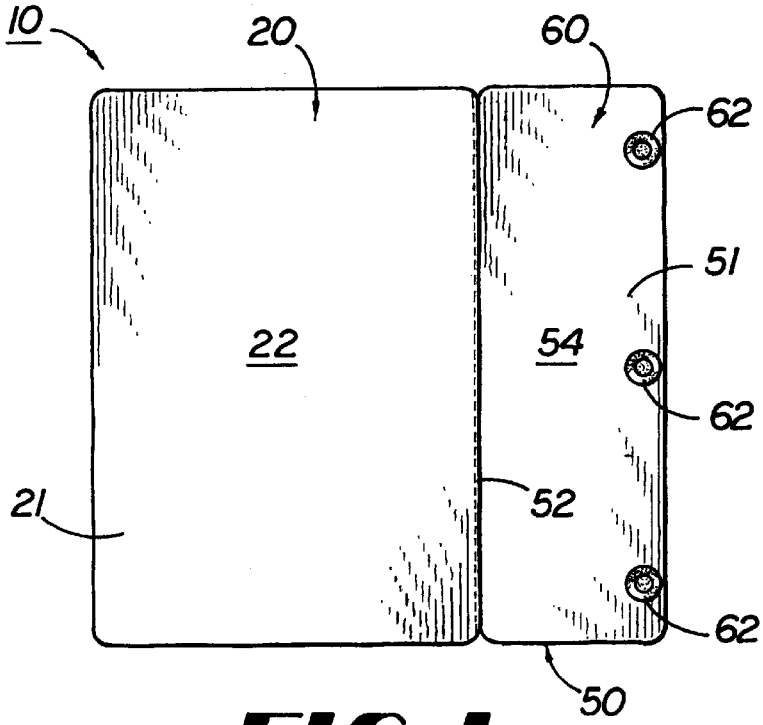
FIG. 1 is a front view of an entryway protection device according to a preferred embodiment of the present invention.

Referring now in detail to the drawing figures, wherein like reference numerals represent like parts throughout the several views, FIG. 1 shows a front view of a preferred embodiment of the present entryway protector 10. Preferably, the entryway protector 10 comprises a main section 20, a minor flap 50 and a securing component 60.

Figure 2:
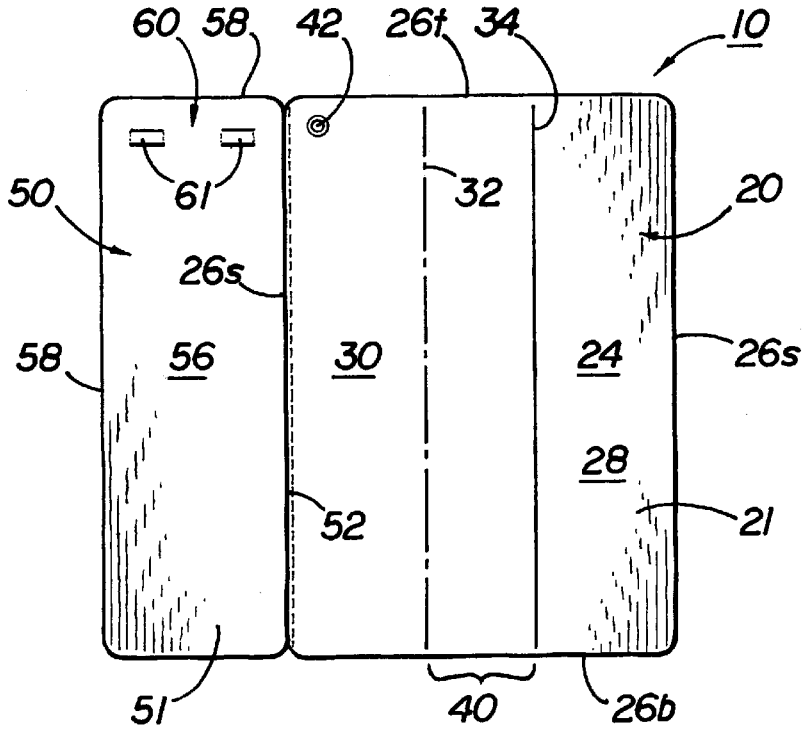
FIG. 2 is a back view of an entryway protection device according to a preferred embodiment of the present invention.

As illustrated in FIGS. 1 and 2, main section 20 comprises a sheet or cover 21 having a front face 22, a back face 24 and top, side and bottom edge walls 26*t*, 26*s*, 26*b*. Main section 20 preferably is rectangular in shape, but can easily incorporate a variety of other shapes and sizes. The front face 20 and back face 24 of main section 20 are separated from one another by edge walls 26*t*, 26*s* and 26*b*. Cover 21 can be designed as an integral cover 21, or faces 20, 24 and walls 26 can be formed of separate sections, and woven, or joined by other known means, together to form cover 21. The width of edge walls 26 define the depth of main section 20, or the amount of protection between an exposed surface and the moving equipment, materials or furniture.

Main section 20 is formed much the same way as a fancy pillowcase with an outer cover surrounding a pocket into which a pillow is slipped and placed. Back face 24 of main section 20 comprises back face first flap 28 and back face second flap 30. Back face first flap 28 terminates at cut line 32, and back face second flap 30 terminates at cut line 34 shown in dotted line extending under back face first flap 28. Back face second flap 30 folds under back face first flap 28 and into the pocket of main section 20. Thus, entrance inside main section 20 and into the pocket, between front face 22 and back face 24, can be had under cut line 32. Overlying zone 40 is formed by back side first panel 28 overlying back side second panel 30.

Figure 3:
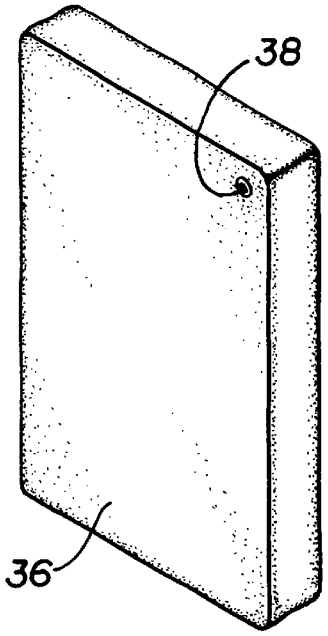
(PRIOR ART) FIG 3
FIG. 3 shows a conventional air mattress used in conjunction with the present invention.
Figure 4:
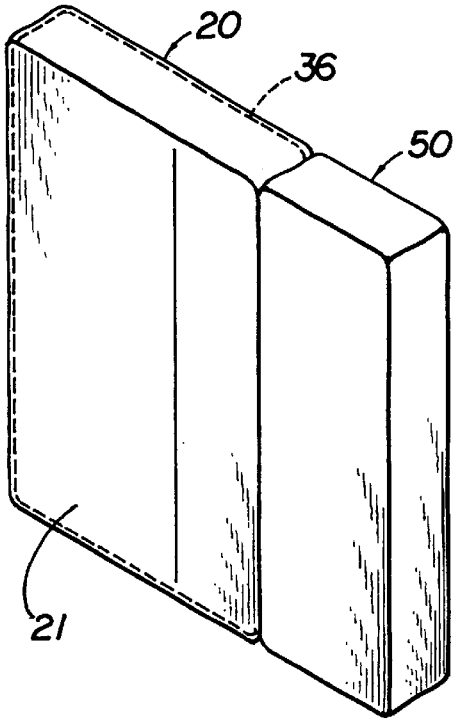
FIG. 4 shows the entryway protection device of FIG. 2 with the air mattress of FIG. 3.

In this preferred embodiment, an air mattress 36 is inserted into the pocket of main section 20 and thereafter inflated to form an inflated main section 20. In FIG. 4, the air mattress 36 is surrounded by the cover 21 of main section 20. As shown in FIG. 3, generally air mattress 36 is provided with air valve 38, which may be a conventional spring bias check valve, of the type used in inner tubes and vehicle tires, and is for the purposes of inflating the air mattress 36. The air valve 38 may be heat welded or adhesively secured to the air mattress 36. Preferably, a deflated air mattress 36 is first slipped into the pocket of main section 20, and the stem of air valve 38 extended through hole 42 cut in back face 24 of main section 20. Then air mattress 36 is inflated. It will be understood that the stem of air valve 38 can extend through cover 21 through a hole 42 located anywhere on main section 20.

In preferred form, sheet or cover 21 comprises a puncture-resistant material so as to protect the inflated air mattress 36 from puncture, such as vinyl and the like which can provide main section 20 with an outer surface that can at least resist bumps and scraps from most construction materials. The cover 21 preferably provides puncture resistance against those objects and forces that typically contact building surfaces during moving or custom construction. The cover 21 also should be of suitable construction to provide a lightweight protection device 10.

The shape of inflated main section 20 is primarily dictated by the shape of inflated air mattress 36. Thus, in one embodiment, main section 20 comprises the shape of the rectangular air mattress 36, which is fully encased by the outer, protective cover 21.

Figure 5:
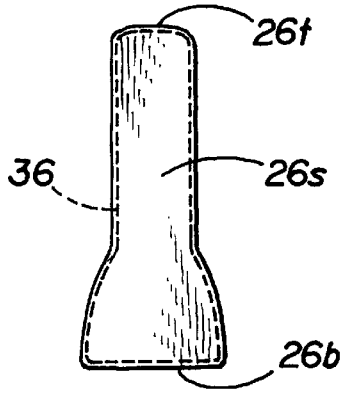
FIG. 5 is a side view of the main section of the present protector according to another preferred embodiment.

Inflated main section 20 preferably has a bottom depth, or width of bottom edge wall 26*b*, sufficient to allow main section 10 to remain upright against a wall when main section 20 is inflated. To increase the stability of main section 20, the width of bottom edge wall 26*b* can be increased by providing a cover 21 wider at the bottom edge wall 26*b* than top edge wall 26*t*. With no constriction by cover 21, air mattress 36 would inflate into a generally rectangular shape having a constant width. Yet in this embodiment as illustrated in FIG. 5, cover 21 is designed to constrict the full inflation of air mattress 36 at its top and middle portions, while providing air mattress 36 greater freedom to expand beyond the width of side wall 26*t* in proximity to bottom edge wall 26*b*. This provides main section 20 with a larger base, increasing the ability of main section 20 to remain upright without external securing. This allows a single main section 20 to adapt to a variety of different air mattress designs, and decreases the amount of cover 21 needed to produce main section 20.

Should protector 10 encounter a puncture or scratch that passes through the cover 21, and the air mattress 36 is punctured, one need only replace a relatively inexpensive air mattress 36 to reuse the protector 10. Alternatively, main section 20 can itself comprise an air tight cover 21 wherein main section 20 merely resembles an air mattress itself. Yet in this embodiment, should the surface 21 of main section 20 be pierced, the whole of main section 20 would need replacement or the hole could be patched.

Figure 6:
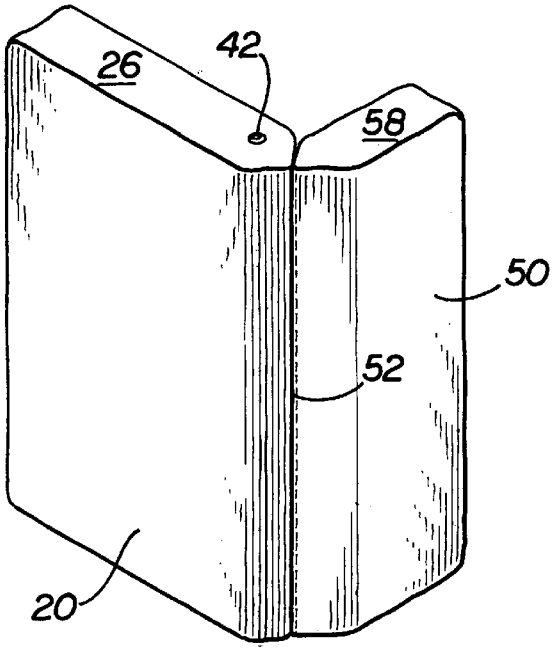
FIG. 6 shows a perspective view of a preferred embodiment of the present invention.

As shown in FIGS. 1 and 2, the entryway protector 10 preferably further comprises minor flap 50. Minor flap 50 attaches to main section 20 along a substantial length of main section 20 by a line of stitching 52. The line of stitching 52 enables the minor flap 50 to rotate independent of main section 20 as shown in FIGS. 5 and 6. As will be obvious, minor flap 50 alternatively can be secured to main section 20 by a number of well known methods, other than by a line of stitching 52.

Minor flap 50 generally comprises a cover material similar to, if not the same as, the cover 21 of main section 20. The covering material 51 of minor flap 50 has a front side 54 and back side 56, both sides 54, 56 continuously connected by edge walls 58. In a preferred embodiment, minor flap 50 comprises a stuffing of padding material surrounded by a closed vinyl cover 21. Alternatively, like main section 20, minor flap 50 can be separately inflatable, or inflated upon inflation of an air tight main section 20.

Figure 7:
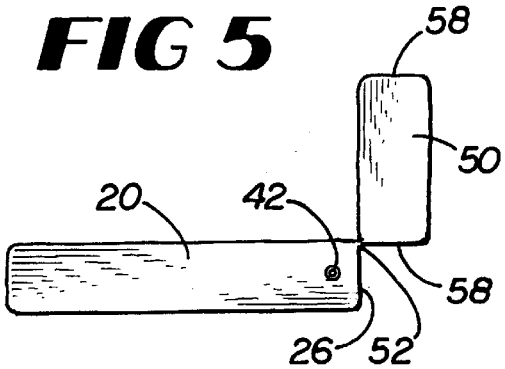
FIG. 7 is a top view of a preferred embodiment of the present invention.

Line of stitching 52 may comprise a side edge of both main section 20 and flap panel 50, as shown in FIG. 6. Alternatively, main section 20 and minor flap 50 can be ringed entirely by their respective edge walls 26, 58 as shown in FIG. 7. As shown in FIG. 7, line of stitching 52 can connect two adjacent corners of main section 20 and flap panel 50.

Figure 8:
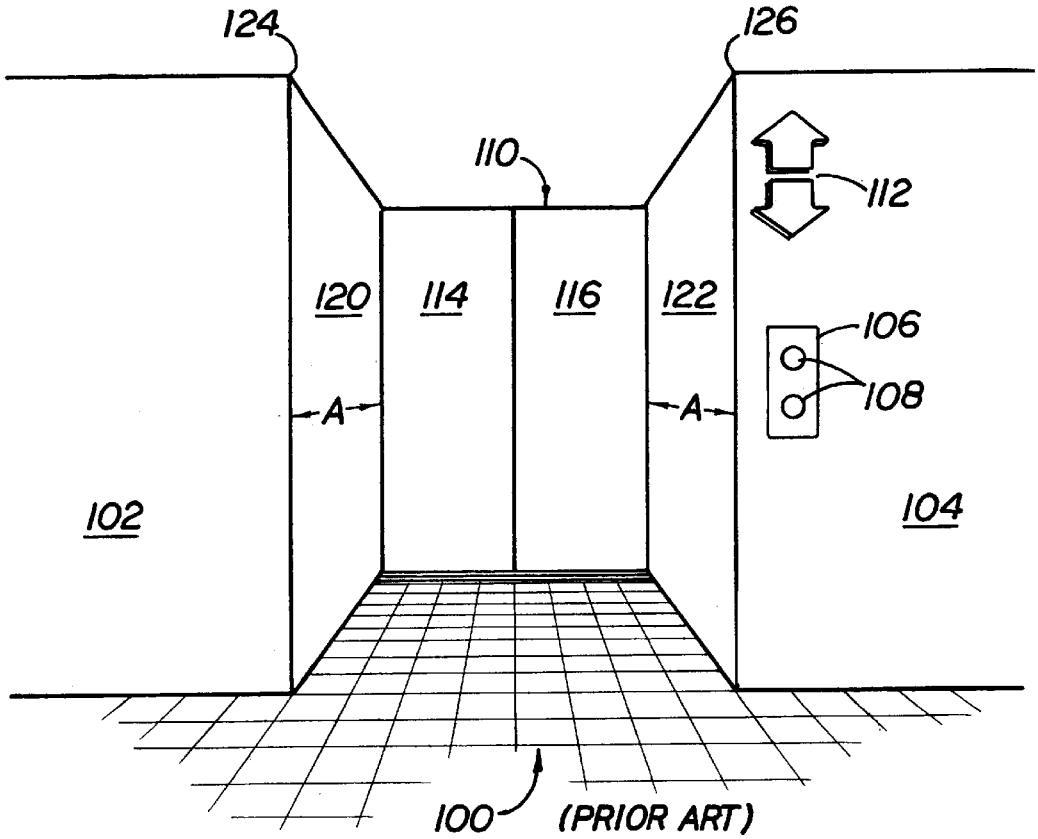
FIG. 8 illustrates a conventional hallway having an inset elevator.

In use, entryway protector 10 protects exposed surfaces from deformation from dents and scratches produced by a collision with construction material, furniture and moving equipment. FIG. 8 depicts a conventional hallway 100 having an elevator 110 set back from the side walls 102, 104 of hallway 100. As shown, side wall 104 typically includes button panel 106, buttons 108 and elevator indicator 112.

Elevator 110 includes elevator doors 114, 116, set back from hallway walls 102, 104. Hallway 100 typically further comprises elevator jamb panels 120, 122 that span the set back depth of elevator doors 114, 116. These jamb panels 120, 122 are specifically prone to damage from moving objects in and out of elevator 110. Jamb panels 120, 122 have a length A being the distance that elevator 110 is set back from hallway walls 102, 104. Generally, hallway walls 102, 104 are perpendicular to jamb panels 120, 122, respectively, thus producing ninety degree corners 124, 126, respectively. The present invention 10 works equally as well with acute or obtuse corners 124, 126.

Figure 9:
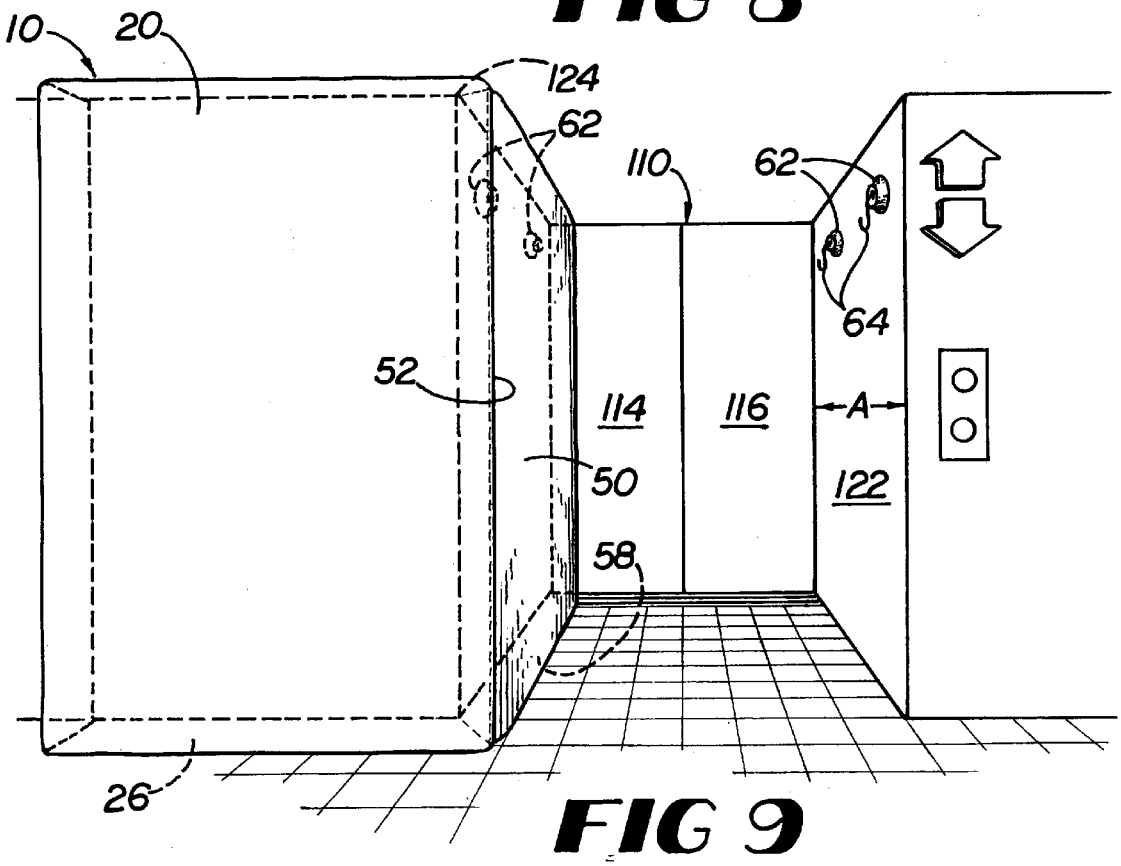
FIG. 9 shows a preferred embodiment of the present invention protecting wall surfaces in proximity to the elevator and hallway of FIG. 8.

In one application of protector 10 shown in FIG. 9, protector 10 is placed as a protective barrier over side wall 102 and jamb panel 120, to protect these surfaces from construction materials and the like passing through elevator doors 114, 116. Main section 20 is left free standing against a length of hallway wall 102. The depth of main section 20 upon inflation, enables main section 20 to remain upright without attaching main section 20 to side wall 102. Thus, hallway wall 102 remains free of distracting holes or extensions that would provide a hanging assembly for the conventional mat or pad.

Protector 10 wraps around comer 124 at line of stitching 52 so that minor flap 50 rests over jamb panel 120. Minor flap 50 preferably extends a substantial width A of jamb panel 120. A top view of the protector 10 shown in FIG. 9 is illustrated in FIG. 7.

The minor flap 50 may not have a sufficient width or rigidity to remain upright without being releasably hung to jamb panel 120. Thus, in one embodiment of the present invention 10, minor flap 50 is provided with securing component 60 comprising straps 61 on its back face 56, as shown in FIG. 2. Preferably, the strap portions 61 are formed in the top portion of minor flap 50. Straps 61 are formed to receive a hanging attachment such as the extending hooks 64 of suction cups 62. As shown in FIG. 9, suction cups 62 with extending hooks 64 preferably engage straps 61 of minor flap 50 to releasably secure minor flap 50 in an upright position against jamb panel 122. Suction cups 62 have been found to work well on jamb panels 120, 122 which have smooth, flat, non-porous surfaces, of, for example, aluminum, marble, steel and formica. Use of suction cups 62 does not require any setup construction in jamb panels 120, 122. It has been found that conventional plastic or rubber suction cups 62 provide enough suction to hold the minor flap 50 upright.

Alternatively, suction cups 62 may be formed integral with minor flap 50 as shown in FIG. 1. The suction cups 62 can either be placed on the front or back sides 54, 56, in any location so as to hold minor panel 50 against jamb panel 120.

Thus described, protector 10 protects portions of hallway wall 102 and jamb panel 120 in proximity to elevator 110. It will be understood that protector 10 can similarly protect hallway wall 104 and jamb panel 122. Protector 10 is easily inflated and hung by just one individual, without in any way damaging hallway wall 102 or jamb panel 120. Should an object either entering or exiting elevator 110 puncture main section 20 and deflate air mattress 36, the protector 10 is removed from contact with hallway wall 102 and jamb panel 120 so that main section 20 can be fitted with a new air mattress 36.

Figure 10:
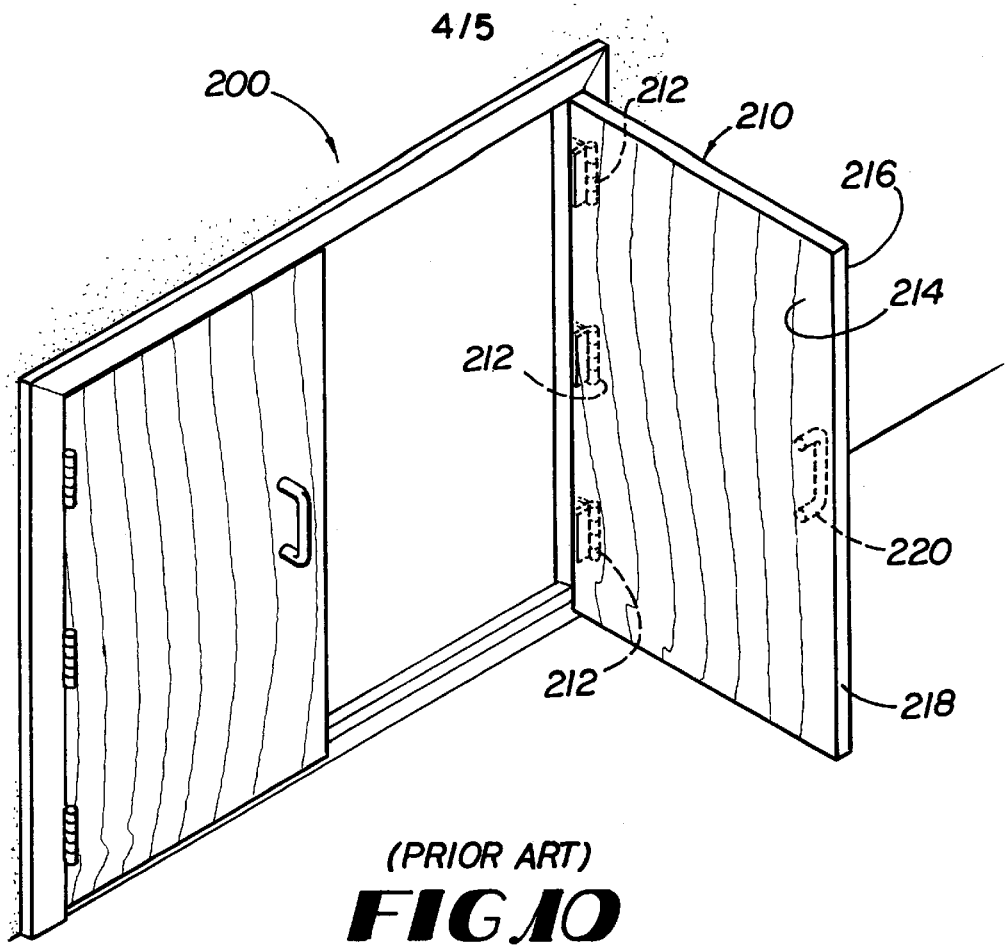
(PRIOR ART) FIG 10
FIG. 10 illustrates a conventional doorway with a door propped opened.

In another use of entryway protector 10, the protector 10 is fitted around a door of a doorway through which the furniture, moving or construction materials pass. FIG. 10 illustrates a common doorway 200 having a door 210 with a handle 220 rotational fixed to a door jamb by hinges 212. Doorway 200 can be a doorway to an apartment complex, office building, or any other type of building. Doorway 200 with door 210 typically creates an obstruction, or narrowing, of a hallway or other passageway in which the doorway is set. For this reason, the open door is often bumped into by objects moving through the passageway.

As shown in FIG. 10, door 210 has an inner surface 214 and an outer surface 216 opposed to surface 214. Inner surface 214 is the exposed surface of door 210 because when door 210 is opened, surface 214 is vulnerable to bumps and scratches from objects traveling through the doorway 200. Similarly, door width 218 is vulnerable to collision from objects moving through doorway 200. It will be understood that should door 210 open the other way through doorway 200, the exposed surface of door 210 would be surface 216.

Figure 11:
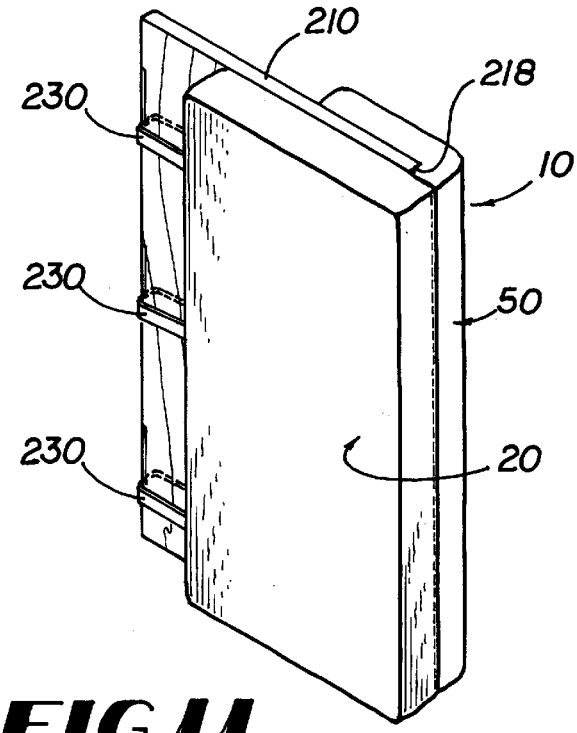
FIG. 11 is a perspective view of a preferred embodiment of the present invention hugging the open door of FIG. 10.

As shown in FIG. 11, door 210 can be wrapped behind entryway protector 10; thus, providing a barrier between moving objects or construction materials and a substantial portion of exposed surface 214 and width 218 of door 210. As shown, minor flap 50 is placed over width 218 and wrapped around a portion of outer surface 216 of door 210.

The main section 20 of protector 10 lies against a substantial portion of exposed surface 214 of door 210, and again can remain upright upon inflation because of its bottom width. Unlike flap 50 if stuffed with padding, main section 20 resists bending to a degree relative to its amount of inflation.

In order to ensure protector 10 will remain in contact with the surfaces of door 210 even upon collision with furniture, moving or construction materials, securing component 60 can comprise belts 230. Preferably, belts 230 adjustably secure main section 20 to minor flap 50 around the width of the door opposed to width 218. Hinges 212 space the door 210 a distance away from the door jamb of doorway 200. This distance allows belts 230 to pass through and around the width of door 210.

Figure 12:
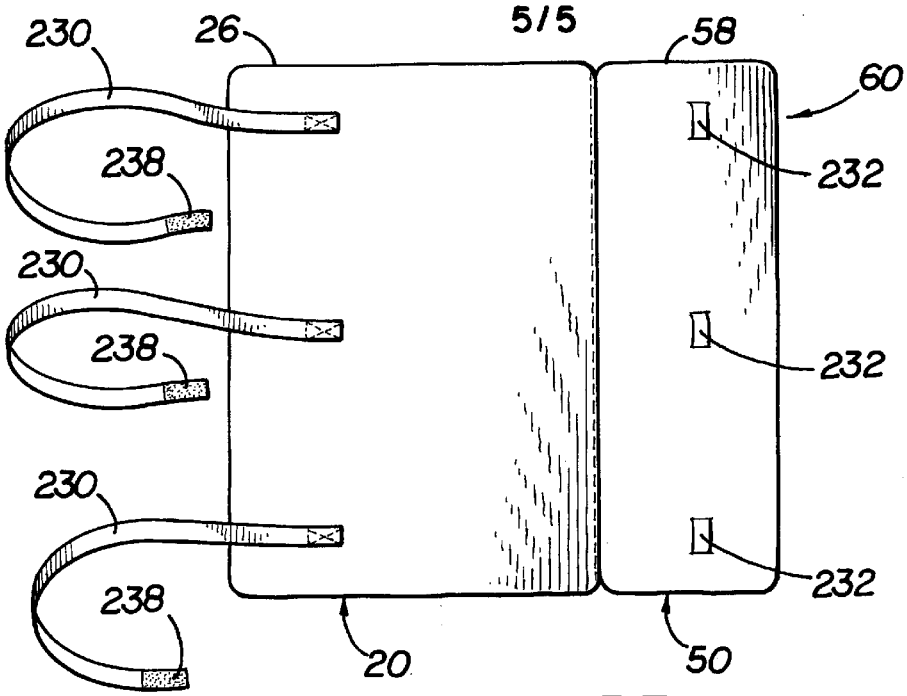
FIG. 12 is one embodiment of the present invention having straps and loops in order to secure the present invention to the door of FIG. 10.

In this embodiment, securing component 60 further comprises buckles and the like to lock the adjustment of belts 230 so that protector 10 stays in place around door 210. For example, as shown in FIG. 12 belts 230 extend from edge wall 26 of main section 20, and minor flap 50 is provided with a securing mechanism 232. As shown, edge walls 26, 50 are those walls opposite the edge walls in proximity to the line of stitching 52. The three ends 238 of belts 230 slip in and through locking mechanism 232 and secure protector 10 around door 210.

It will be understood that other suitable embodiments of securing component 60 can be constructed. Belts 230 may extend from any suitable location on main section 20 and secure to minor flap 50 in any suitable location and by a variety of securing components. For example, securing components 60 may comprise snaps located on the free end 238 of belts 230 or a strap buckle assembly. In another embodiment, hook and loop fasteners can be used to secure belts 230. Further, protector 10 can be secured to door 210 by similar means as described previously in relation to the elevator 110. In this embodiment, no belts 230 would be required.

Figure 13:
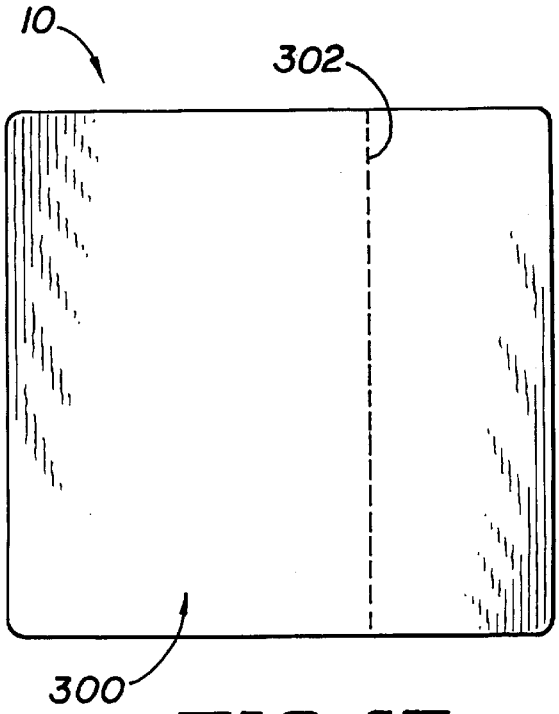
FIG. 13 is a front view of another preferred embodiment of the present invention.
Figure 14:
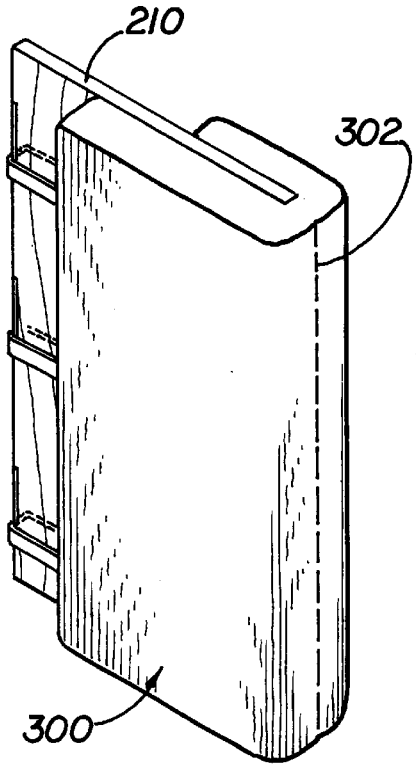
FIG. 14 is a perspective view of the entryway protector of FIG. 13 hugging an open door.

Other embodiments of protector 10 can be constructed. As shown in FIG. 13, entryway protector 10 can comprise a single inflatable unit 300 having a line of folding 302 providing a fold about which inflatable unit 300 can be folded to form configurations as discussed above. For example, FIG. 14 shows unit 300 wrapping around door 210 generally at line of folding 302.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A device for protecting an exposed surface comprising:

an inflatable main section with a bottom edge wall having a width sufficient to allow main section to remain upright against the exposed surface to be protected when the inflatable main section is inflated;

(b) a minor flap rotatably connected to said main inflatable section, said minor flap being fixedly connected to said main inflatable section; and (c) securing components attached to said minor flap for securing said minor flap to the exposed surface to be protected.

2. The device of claim 1, wherein said inflatable main section comprises:

(a) a first cover having a front face, a back face and top, side and bottom edge walls; and (b) an inflatable device encased in said first cover, and inflatable through said first cover.

3. The device of claim 2, wherein said back face of said first cover of said main inflatable section incorporates a back face first flap and a back face second flap, said back face second flap capable of folding under said back face first flap.

4. The device of claim 3, wherein said inflatable device comprises an air mattress, said air mattress encased in said first cover through an access into said first cover between said back face first flap and said back face second flap.

5. The device of claim 4, wherein said minor flap comprises a second cover stuffed with padding material.

6. The device of claim 4, wherein said minor flap is inflatable.

7. The device of claim 5, wherein said bottom edge wall of said main section is significantly wider than said top edge wall of said main section.

8. The device of claim 7, wherein said minor flap is rotatably connected to a side edge wall of said main section by a line of stitching.

9. The device of claim 8, wherein said securing components comprise suction cups.

10. The device of claim 8, wherein said securing components comprise belts and fastening means.

11. A method of protecting exposed first and second surfaces comprising the following steps:

(a) providing an inflatable protection device having (i) a main inflatable section with means to keep said inflatable main section in place on the exposed first surface to be protected, (ii) a minor flap rotatably connected to said main inflatable section, said minor flap being fixedly connected to said main inflatable section, and (iii) securing components attached to said minor flap for securing said minor flap to the exposed second surface to be protected;

(b) inflating said main inflatable section of said protection device;

(c) securing said minor flap to the exposed second surface using said securing components.

12. The method of protecting according to claim 11, wherein the first and second surfaces meet at a comer and extend from the comer at an angle from each other, said method of protecting further comprising step (d) of folding said protection device about the corner at the connection of said main inflatable section and said minor flap until said main inflatable section leans against a portion of the first surface.

13. The method of protecting according to claim 11, wherein said inflatable main section comprises:

(a) a first cover having a front face, a back face and top, side and bottom edge walls; and (b) an inflatable device encased in said first cover, and inflatable through said first cover.

14. The method of protecting according to claim 13, wherein said back face of said first cover of said main inflatable section incorporates a back face first flap and a back face second flap, said back face second flap capable of folding under said back face first flap.

15. The method of protecting according to claim 14, wherein said inflatable device comprises an air mattress, said air mattress encased in said first cover through an access into said first cover between said back face first flap and said back face second flap.

16. The method of protecting according to claim 15, wherein said minor flap comprises a second cover stuffed with padding material.

17. The method of protecting according to claim 15, wherein said minor flap is inflatable.

18. The method of protecting according to claim 16, wherein said bottom edge wall of said main section is significantly wider than said top edge wall of said main section.

19. The method of protecting according to claim 18, wherein said minor flap is rotatably connected to a side edge wall of said main section by a line of stitching.

20. The method of protecting according to claim 19, wherein said securing components comprise suction cups.

* * * * *